United States Patent [19]

Nagata et al.

[11] Patent Number: 4,947,210

[45] Date of Patent: Aug. 7, 1990

[54] MULTI-COLOR COPYING MACHINE

[75] Inventors: Kenzo Nagata; Kazuhiro Araki; Hirohisa Miyamoto, all of Osaka, Japan

[73] Assignee: Minolta Camera Kabushiki Kaisha, Osaka, Japan

[21] Appl. No.: 212,247

[22] Filed: Jun. 27, 1988

[30] Foreign Application Priority Data

Jul. 1, 1987 [JP] Japan ..... 62-164164

[51] Int. Cl.[5] ..... G03G 21/00

[52] U.S. Cl. ..... 355/218; 355/326; 355/245

[58] Field of Search ..... 355/7, 4, 14 D

[56] References Cited

U.S. PATENT DOCUMENTS

| | | | |
|---|---|---|---|
| 2,910,963 | 11/1969 | Herman . | |
| 3,572,288 | 8/1968 | Turner . | |
| 3,914,043 | 10/1975 | McVeigh | 355/4 |
| 3,960,445 | 6/1976 | Drawe | 355/4 |
| 3,967,891 | 7/1976 | Rippstein . | |
| 4,099,860 | 7/1978 | Connin . | |
| 4,256,400 | 3/1981 | Komori et al. | 355/14 SH |
| 4,275,958 | 6/1981 | Tachika et al. . | |
| 4,336,994 | 6/1982 | Banton . | |
| 4,346,982 | 8/1982 | Nakajima et al. . | |
| 4,373,798 | 2/1983 | Tsukada et al. . | |
| 4,552,449 | 11/1985 | Wakamatsu et al. | 355/7 X |
| 4,572,102 | 2/1986 | Yuge et al. . | |
| 4,579,443 | 4/1986 | Abuyama et al. . | |
| 4,582,417 | 4/1986 | Yagasaki et al. | 355/7 |
| 4,587,568 | 5/1986 | Takayama et al. . | |
| 4,619,514 | 10/1986 | Ide . | |
| 4,627,707 | 12/1986 | Tani et al. | 355/14 R |
| 4,634,259 | 1/1987 | Oishi et al. . | |
| 4,641,602 | 2/1987 | Kasai . | |
| 4,655,580 | 4/1987 | Watanabe et al. | 355/7 |
| 4,657,376 | 4/1987 | Ide . | |
| 4,659,211 | 4/1987 | Oka . | |
| 4,666,288 | 5/1987 | Watanabe . | |
| 4,668,978 | 5/1987 | Gokita . | |
| 4,685,794 | 8/1987 | Watanabe . | |
| 4,690,543 | 9/1987 | Watanabe . | |
| 4,710,016 | 12/1987 | Watanabe . | |
| 4,720,730 | 1/1988 | Ito . | |
| 4,723,148 | 2/1988 | Hamakawa . | |
| 4,728,985 | 3/1988 | Nakashima et al. . | |
| 4,731,637 | 3/1988 | Acquaviva et al. | 355/14 SH |
| 4,740,811 | 4/1988 | Watanabe . | |
| 4,743,945 | 5/1988 | Ito et al. . | |
| 4,743,946 | 5/1988 | Nishimori et al. . | |
| 4,745,437 | 5/1988 | Oka et al. . | |
| 4,746,954 | 5/1988 | Matuura et al. . | |
| 4,754,301 | 6/1988 | Kasamura et al. . | |
| 4,772,921 | 9/1988 | Ito . | |
| 4,803,520 | 2/1989 | Tomosada et al. | 355/7 |

FOREIGN PATENT DOCUMENTS

| | | |
|---|---|---|
| 3705511 | 9/1987 | Fed. Rep. of Germany . |
| 0022212 | 7/1973 | Japan . |
| 0134635 | 11/1976 | Japan . |
| 0030833 | 3/1979 | Japan . |
| 0170868 | 9/1985 | Japan . |
| 0194469 | 10/1985 | Japan . |
| 0212778 | 10/1985 | Japan . |
| 0072270 | 4/1986 | Japan . |
| 61-203474 | 9/1986 | Japan . |
| 0061464 | 3/1987 | Japan . |
| 0090186 | 6/1987 | Japan . |
| 0059504 | 12/1987 | Japan . |

*Primary Examiner*—A. T. Grimley
*Assistant Examiner*—Robert Beatty
*Attorney, Agent, or Firm*—Burns, Doane, Swecker & Mathis

[57] ABSTRACT

A copying machine which includes several developing units adapted to accommodate respective masses of powdery developers of different colors; a specifying unit for specifying a position, which will constitute the boundary of a copying area, in a direction conforming to the direction of scan of a scanning system; a copying contorl unit for selectively switching and driving the developing units in correspondence with the position of the boundary of the copying area specified by the specifying unit, so as to accomplish a multi-color copying during one cycle of copying operation, and an eraser for erasing a predetermined range in the scanning direction in reference to the position of the boundary of the copying area specified by the specifying unit.

2 Claims, 10 Drawing Sheets

| Toner Color | Switch (SW1) | Switch (SW2) |
|---|---|---|
| Black | ON | ON |
| Red | ON | OFF |
| Yellow | OFF | ON |
| -- | OFF | OFF |

MULTI-COLOR COPYING MACHINE

BACKGROUND OF THE INVENTION

1. Field of the Invention

The present invention generally relates to an electrophotographic copying machine and, more particularly, to the electrophotographic copying machine, or multicolor copying machine, capable of reproducing an image in a plurality of colors.

2. Description of the Prior Art

An example of multi-color copying machine is disclosed in the Japanese Laid-open Pat. Publication No.61-203474. The multi-color copying machine disclosed therein is so designed that a plurality of developing units accommodating therein respective masses of powdery developers of different colors can be selectively driven in association with a particular copying area specified by means of an image editing means to accomplish a multi-color copying during one cycle of copying operation.

The developing units according to the above mentioned publication are arranged one after another in a direction conforming to the direction of rotation of a photoreceptor drum, and control is made so that the developing units can be selectively driven or halted in synchronism with the arrival of an electrostatic latent image on the photoreceptor drum, which corresponds to the boundary of the copying area so specified, at an associated developing area.

It has, however, been found that, when control is made to stop the drive of the first developing unit relative to the boundary of the specified copying area, that is, a developer switching position, and to start the drive of the other developing unit, an color mixed area necessarily occurs at an overlapping region between an set-up portion and a set-down portion as shown in FIG. 8. The occurrence of the color mixed area brings about reduction in quality of the resultant color copy and, at the same time, constitutes a cause of incapability of providing a clear color copy because the powdery developer contained in the first developing unit tends to be drawn into and mixed with the powdery developer in the other developing unit.

SUMMARY OF THE INVENTION

Accordingly, the present invention has been aimed at substantially eliminating the above discussed problem inherent in the prior art electrophotographic multicolor copying machine. For this purpose, the present invention provides an improved copying machine which comprises a plurality of developing units adapted to accommodate therein respective masses of powdery developers of different colors, a specifying means for specifying a position, which will constitute the boundary of a copying area, in a direction conforming to the direction of scan of a scanning system, a copying control means for selectively switching and driving the developing units in correspondence with the position of the boundary of the copying area specified by the specifying means, thereby to accomplish a multi-color copying during one cycle of copying operation, and an erasure means for erasing a predetermined range in the scanning direction in reference to the position of the boundary of the copying area specified by the specifying means.

BRIEF DESCRIPTION OF THE DRAWINGS

This and other objects and features of the present invention will become readily understood from the following description taken in conjunction with a preferred embodiment thereof with reference to the accompanying drawings, in which.

DETAILED DESCRIPTION OF THE EMBODIMENT

One embodiment of the present invention will be described with reference to the accompanying drawings in connection with a copying machine of a type capable of synthesizing and copying an image in two colors simultaneously.

Figure 1:
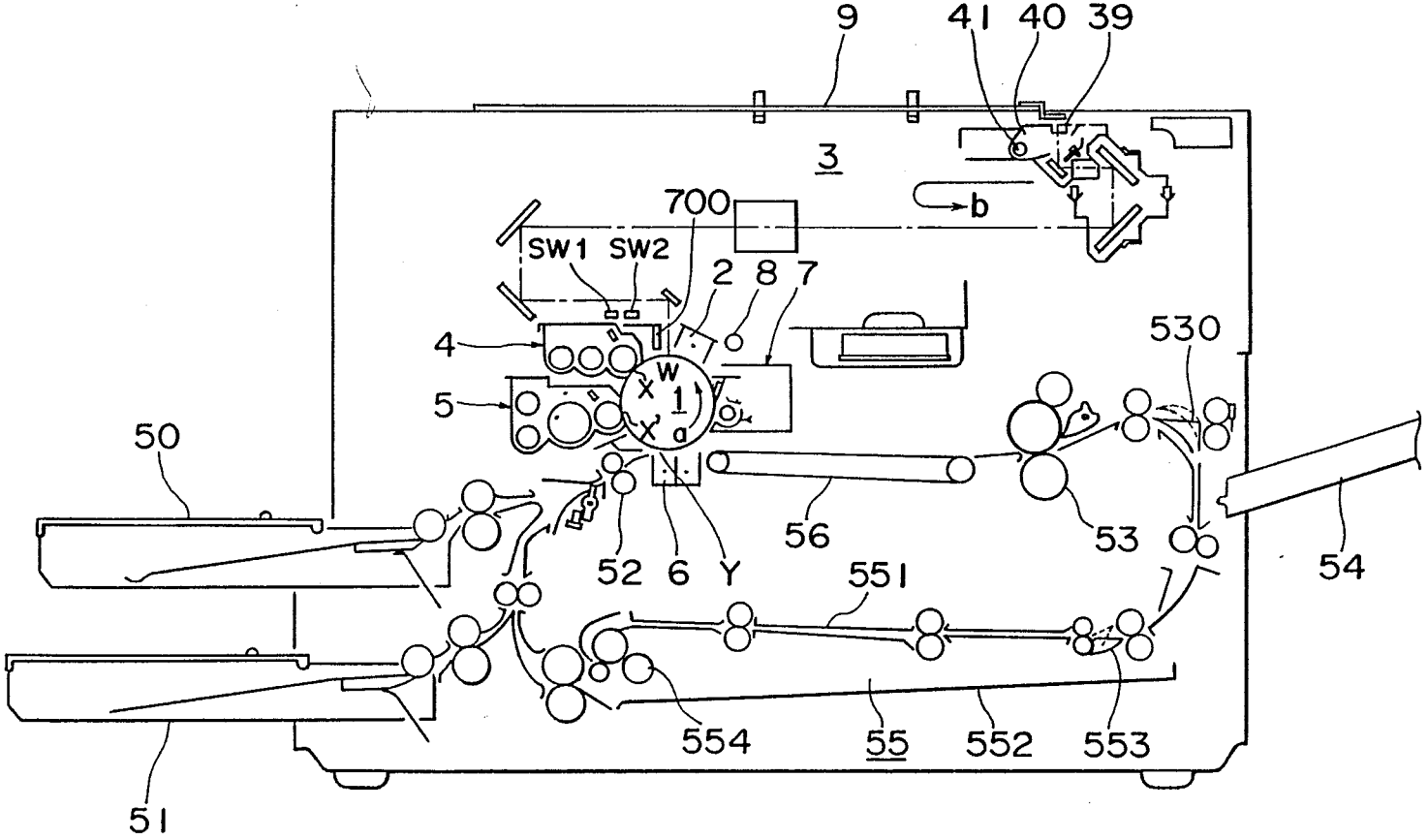
FIG. 1 is a schematic side longitudinal sectional view of a bicolor copying machine embodying the present invention.

Referring first to FIG. 1 which illustrates in schematic longitudinal sectional representation the bicolor copying machine, the general structure of such machine will now be described in terms of a standard copying operation in which an image of a document is reproduced in the form as presented.

The copying machine comprises an endless photoreceptor drum 1 supported for rotation in one direction shown by the arrow a. During the rotation of the photoreceptor drum 1, a surface of the photoreceptor drum 1 is uniformly charged to a predetermined potential by the effect of a discharge taking place in a charger 2.

Then, while a scanner 40 having an illuminator lamp 41 of an optical system 3 undergoes a scanning motion b, a document placed on a transparent document support 9 is illuminated and rays of light reflected from the document are projected onto the surface of the photoreceptor drum 1 at an exposure point W through mirrors and a lens assembly, thereby to form on the surface of the photoreceptor drum 1 an electrostatic latent image complemental in shape to the original image of the document to be copied.

The electrostatic latent image is, when supplied with toner material at either a developing region X or a developing region X' which confronts a first or second developing unit 4 or 5, respectively, rendered visible in the form of a powder image which is a substantial replica of the original image of the document.

On the other hand, a copying paper is supplied selectively from one of paper supply units 50 and 51 and is, after having been timed at a timing roller pair 52 with the arrival of the powder image on the photoreceptor drum 1, transported towards a transfer region Y where a transfer charger 6 is disposed in face-to-face relationship with the photoreceptor drum 1. At this transfer region Y, the powder image on the photoreceptor drum 1 is transferred onto the copying paper and, thereafter, the copying paper bearing the powder image is conveyed by a conveyor belt 56 towards a fixing roller pair 53 by which the powder image on the copying paper is fused and fixed on such copying paper prior to the copying paper being ejected onto a copy receiving tray 54.

However, where a duplex copy mode or a synthetic copy mode is selected, a first changeover claw 530 is moved to a position shown by the phantom line in FIG. 1 to allow the copying paper to be guided towards a duplex unit 55. During the duplex copy mode, the copying paper is, after having passed through an inverting passage 551, accommodated in an intermediate tray 552 having been turned upside down. On the other hand, during the synthetic copy mode, a second changeover claw 553 is moved to a position shown by the phantom line in FIG..1 to allow the copying paper to be fed into the intermediate tray 552 without being turned upside down.

The copying paper accommodated in the intermediate tray 552 is again transported by a paper re-feed roller 554 to the transfer region Y so that, during the subsequent, second copying operation with the optical system 3 and the photoreceptor drum 1 operating in manners similar to those during the first copying operation, another or the same image can be copied on a reverse surface of the copying paper during the duplex copy mode, or on the same surface of the copying paper during the synthetic copy mode.

Residue toner remaining on the surface of the photoreceptor drum 1 can be removed by a cleaning unit 7, and residue charge remaining on the surface of the photoreceptor drum 1 can be subsequently removed by the radiation from an eraser lamp 8 in readiness for the next cycle of copying operation.

The copying machine of the type capable of operating in the manner as hereinabove described is so designed as to execute not only the above described standard copying, but also a process of making a synthetic bicolor copy (simultaneous copying of one image in two colors) with the scanner 40 undergoing a single scanning operation. For this purpose, the first and second developing units 4 and 5 and a control panel 70 (See FIG. 10) are provided with specially designed mechanisms, respectively.

In addition, as shown in FIG. 1, reference numeral 700 represents an inter-image eraser operable to erase a predetermined area in a direction conforming to the scanning direction in reference to a developing unit switching position for a copying area specified by an image editing means during the selection of a simultaneous bicolor copying mode.

The details of the first and second developing units 4 and 5 will now be described.

The first and second developing units 4 and 5 are detachably installed in the body of the copying machine and are interchangeable with similar developing units of identical construction containing respective masses of powdery developers of different colors. In the illustrated embodiment, the first and second developing units 4 and 5 are interchangeable with the black color developing unit containing a mass of powdery developer composed of black toner particles and carriers, the red color developing unit containing a mass of powdery developer composed of red toner particles and carriers, or the yellow color developing unit containing a mass of powdery developer composed of yellow toner particles and carriers.

Accordingly, means is necessitated for detecting which ones of the black, red and yellow color developing units are installed in the body of the copying machine as the first and second developing units 4 and 5.

However, in the illustrated embodiment, it is assumed that the black color developing unit is installed at all time as the second developing unit 5 whereas one of the black, red and yellow color developing units is interchangeably installed at any desired time as the first developing unit 4.

In the body of the copying machine, two magnet switches SW1 and SW2 are disposed at a site where the first developing unit 4 is installed. On the other hand, the black color developing unit is provided with two magnets associated respectively with the switches SW1 and SW2, the red color developing unit 4 is provided with one magnet associated with the switch SW1, and the yellow developing unit is provided with one magnet associated with the switch SW2, all of these magnets being not illustrated for the sake of brevity.

Figures 8, 9:
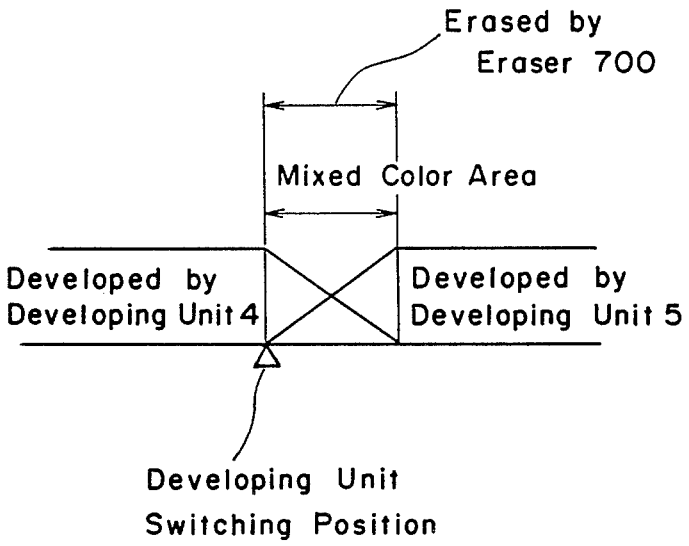
FIG. 8 is an explanatory diagram used to explain the occurrence of the color mixed area.
FIG. 9 illustrates a color code table.

As shown in the color code table in FIG. 9, both of the switches SW1 and SW2 are turned on when the black color developing unit is installed as the first developing unit 4; only the switch SW1 is turned on when the red color developing unit is installed; only the switch SW2 is turned on when the yellow color developing unit is installed; and no one of the switches SW1 and SW2 are turned on when neither of these developing units is installed. An output from one or both of these switches SW1 and SW2 is adapted to be supplied to a control unit (not shown).

Figure 2:
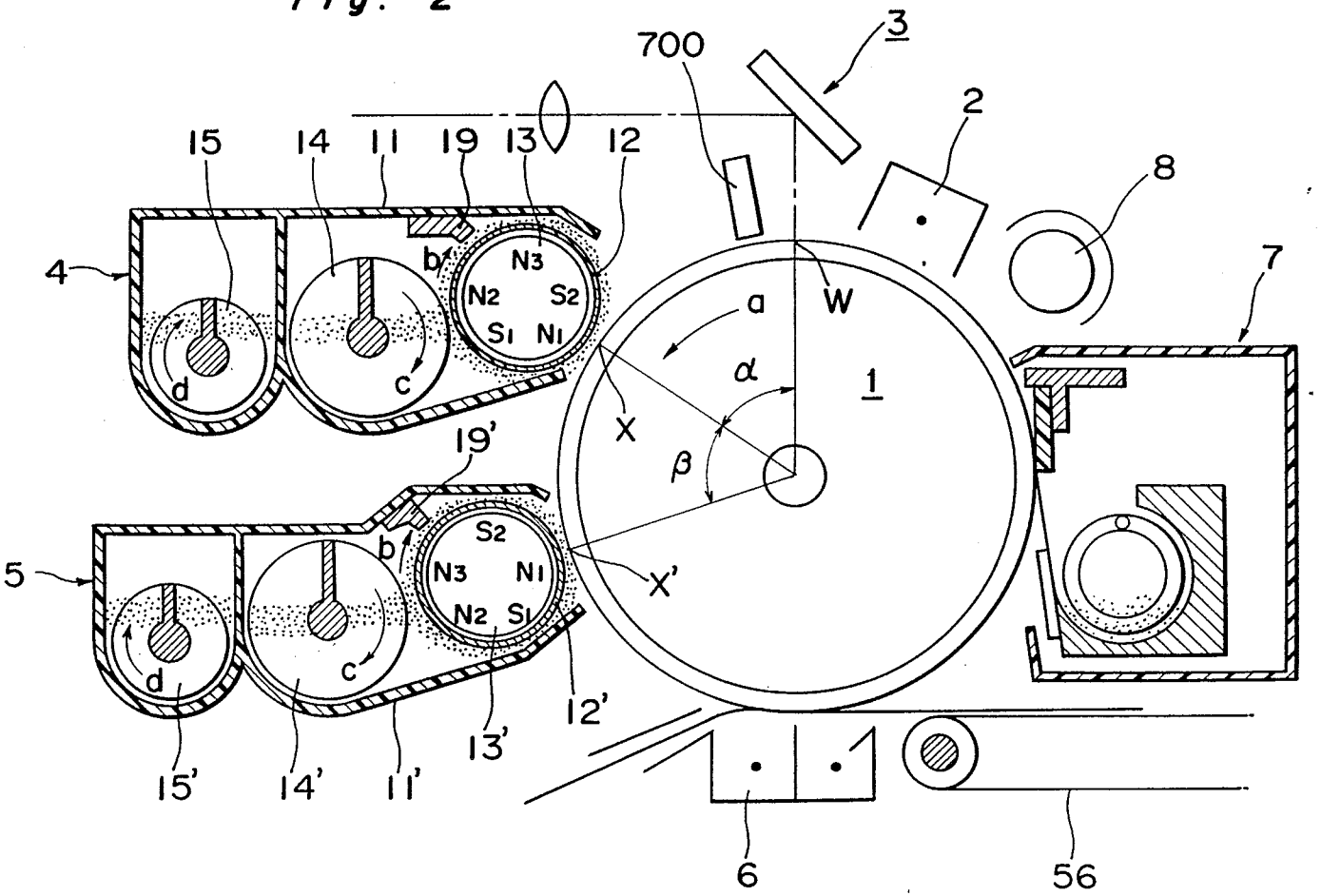
FIG. 2 is a sectional view showing the manner in which first and second developing units are arranged in relation to a photoreceptor drum in the copying machine of FIG. 1.

The first and second developing units 4 and 5 are of identical construction as shown in FIG. 2 and comprise a casing 11 in which a developing sleeve 12, a supply roller 14 and a screw 15 are arranged with the developing sleeve 12 and the screw 15 positioned closest to and remote from the photoreceptor drum 1, respectively.

The developing sleeve 12 used therein is made of non-magnetizeable, electroconductive material and is shaped to represent a cylindrical body ($\phi$ 24.5 mm) having its outer peripheral surface roughened by the use of a sand blasting technique to have fine surface irregularities. This developing sleeve 12 is so positioned as to form a developing gap Ds (=0.6 mm) at the respective developing region X or X' between it and the photoreceptor drum 1, and the angle of rotation of the photoreceptor drum 1 from the exposure point W to the developing region X or X' is set to be $\alpha$ or $\alpha+\beta$. In the illustrated embodiment, the angles $\alpha$ and $\beta$ are selected to be 56° and 52°.

Behind the developing region X of the developing sleeve 12, a bristle height adjusting member 19 secured to an inner upper portion of the casing 11 is positioned so as to confront the developing sleeve 12 with a bristle height adjusting gap Db (=0.4 mm) intervening therebetween.

Within the developing sleeve 12, a magnet roller 13 comprised of a plurality of magnets arranged so as to extend in a direction parallel to the longitudinal axis thereof is disposed having a plurality of magnetic poles N1 to N3 and S1 and S2 positioned on the periphery thereof. These magnetic poles N1, N2, N3, S1 and S2 emanate respective magnetic forces of 1,000 gausses, 500 gausses, 500 gausses, 800 gausses and 800 gausses.

Figure 4:
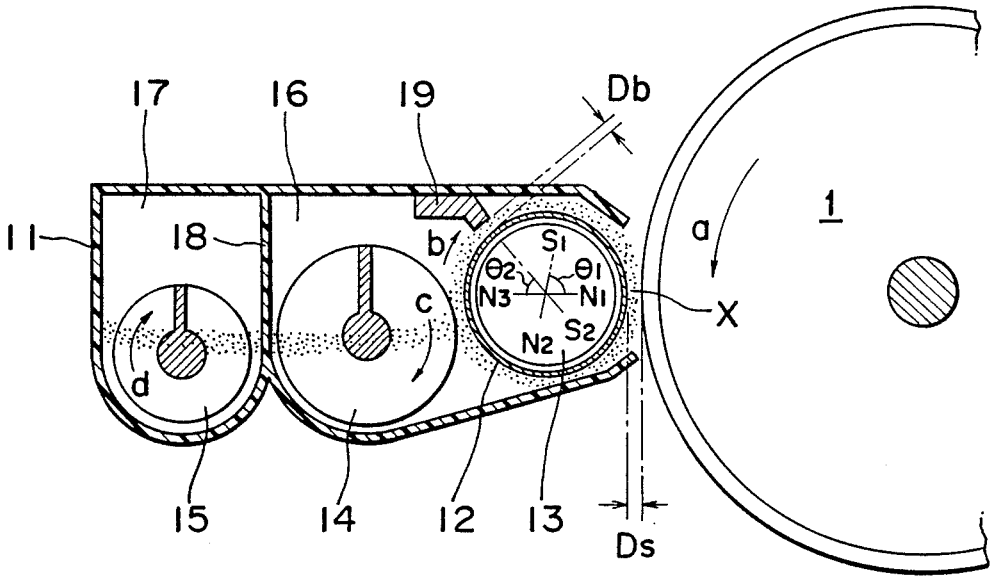
FIG. 4 is a sectional view showing a magnet roller in the first developing unit in position ready to effect a developing operation.

As shown in FIG. 4, the center of the magnetic pole N1 is located at a position spaced an angle $\theta 1$ (=80°) clockwise about the center of the magnetic pole S1, and the magnetic pole N3 has its center located at a position spaced an angle $\theta 2$ (=40°) counterclockwise from the position adjacent the bristle height adjusting member 19 when the magnetic pole N1 confronts the photoreceptor drum 1.

Figure 3:
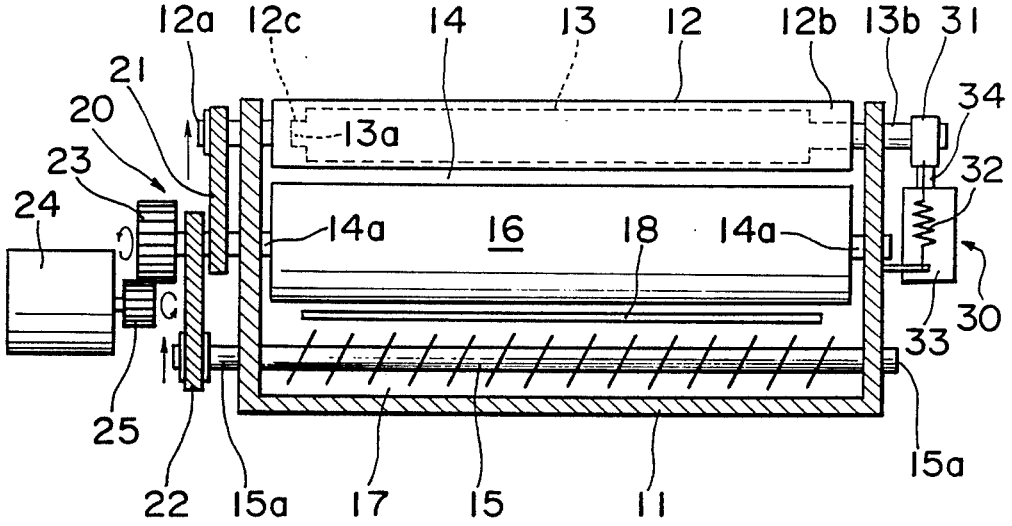
FIG. 3 is a longitudinal sectional view of the first developing unit.

As best shown in FIG. 3, the magnet roller 13 has a pair of opposite stud shafts 13*a* and 13*b* coaxially protruding from the respective opposite ends thereof in a direction away from each other, the stud shaft 13*a* being rotatably received in a bearing recess 12*c* formed inside the developing sleeve 12 whereas the other stud shaft 13*b* is rotatably supported by a lateral wall of the casing 11 so that the magnet roller 13 can be rotated a predetermined angle $\theta 1$ (=40°) by a displacing means 30 as will be described later.

On the other hand, the developing sleeve 12 has a right-hand bearing portion 12*b* (as viewed in FIG. 3) supported by the stud shaft 13*b* of the magnet roller 13, and also has a stud shaft 12*a* opposite to the bearing portion 12*b* supported by a lateral wall of the casing 11 so that the developing sleeve 12 can be rotated by a drive means 20.

The supply roller 14 and the screw 15 are accommodated within respective conveyance passages 16 and 17 partitioned from each other by a partition wall 18 and have their respective stud shafts 14*a* and 15*a* rotatably supported by the lateral wall of the casing 11 and drivingly coupled with the drive means 20. It is to be noted that the conveyance passages 16 and 17 are communicated with each other at opposite end portions of the casing 11 as shown in FIG. 3.

The drive means 20 for the first and second developing units 4 and 5, the supply roller 14 and the screw 15 will now be described.

As shown in FIG. 3, the stud shaft 12*a* of the developing sleeve 12 and the stud shaft 14*a* of the supply roller 14*a* are coupled with each other through a drive belt 21 trained therebetween, and similarly, the stud shaft 14*a* of the supply roller 14 and the stud shaft 15*a* of the screw 15 are coupled with each other through a drive belt 22 trained therebetween.

The stud shaft 14*a* of the supply roller 14 has a gear 23 rigidly mounted thereon, which gear 23 is meshed with a drive gear 25 of a drive motor 24.

Accordingly, when the motor 24 is driven to drive the drive gear 25 in a direction shown by the solid line in FIG. 3, the gear 23 and the belts 21 and 22 are driven in respective directions shown by the solid lines with the developing sleeve 12, the supply roller 14 and the screw 15 consequently rotated in respective directions shown by the arrows b, c and d. In the illustrated instance, the developing sleeve 12 can be driven at 240 rpm.

Figure 5:
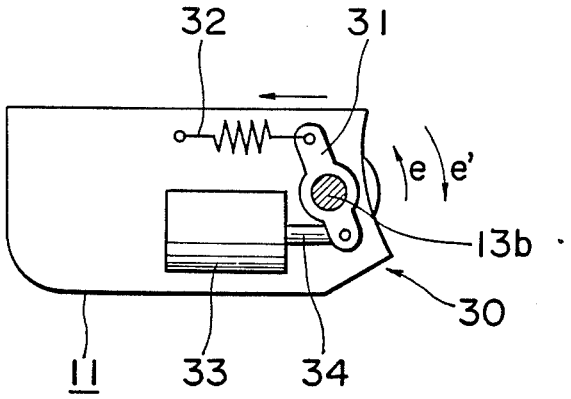
FIG. 5 is a schematic front elevational view of a displacing means for the magnet roller held in an operative position.
Figure 7:
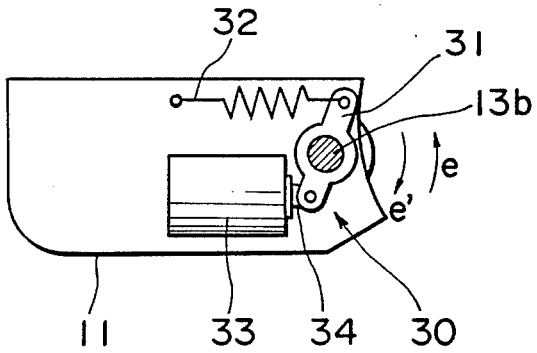
FIG. 7 is a view similar to FIG. 5, showing the drive means held in an inoperative position.

The displacing means 30 for the magnet roller 13 comprises, as best shown in FIGS. 5 and 7, a lever 31, a spring 32 and a solenoid unit 33. The lever 31 is fixedly mounted on the stud shaft 13*b* of the magnet roller 13. The lever 31 has one end to which one end of the spring 32, which is secured at the other end thereof to the casing 11, is connected so that the lever 31 can be normally biased by the spring 32 in one direction shown by the arrow e. The other end of the lever 31 is coupled to a plunger 34 of the solenoid unit 33 such that, when the solenoid unit 33 is driven, the lever 31 can be pivoted in a direction shown by the arrow e' against the biasing force of the spring 32.

When the solenoid unit 33 is in inoperative position, that is, when the lever 31 is in a position shown in FIG. 5, the magnetic pole N1 of the magnet roller 13 confronts the photoreceptor drum 1 and the magnetic pole N3 of the same m roller 13 is retracted to a position moved an angle $\theta_2$ (=40°) counterclockwise from the position adjacent the bristle height adjusting member 19 as shown in FIG. 4.

Figure 6:
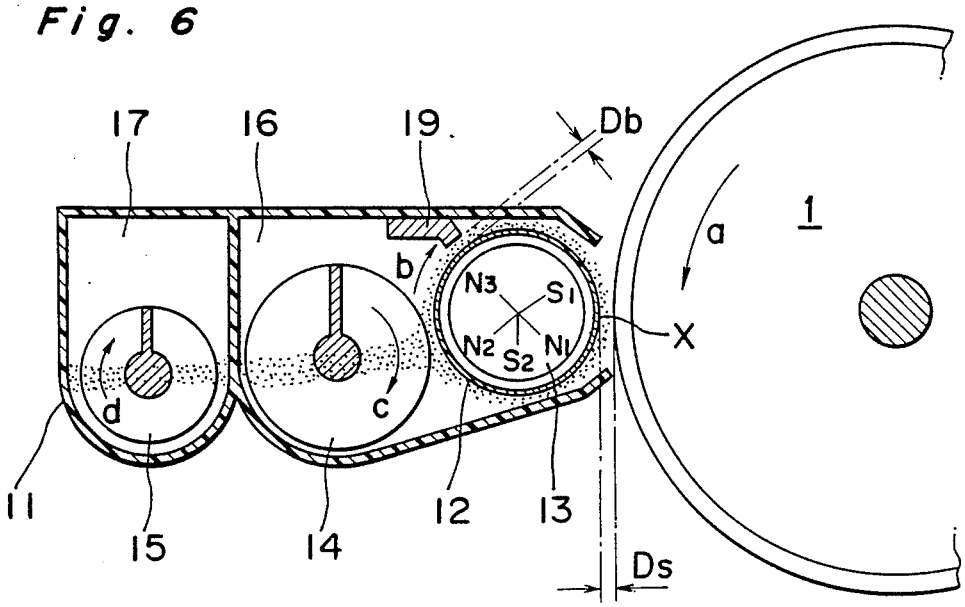
FIG. 6 is a view similar to FIG. 4, showing the magnet roller held in position completing the developing operation.

Conversely, when the solenoid unit 33 is driven with the lever 31 held in position as shown in FIG. 7, the magnetic pole N3 confronts the bristle height adjusting member 19 and an intermediate portion between the magnetic poles N1 and S1 confronts the photoreceptor drum 1 as shown in FIG. 6.

Figure 10:
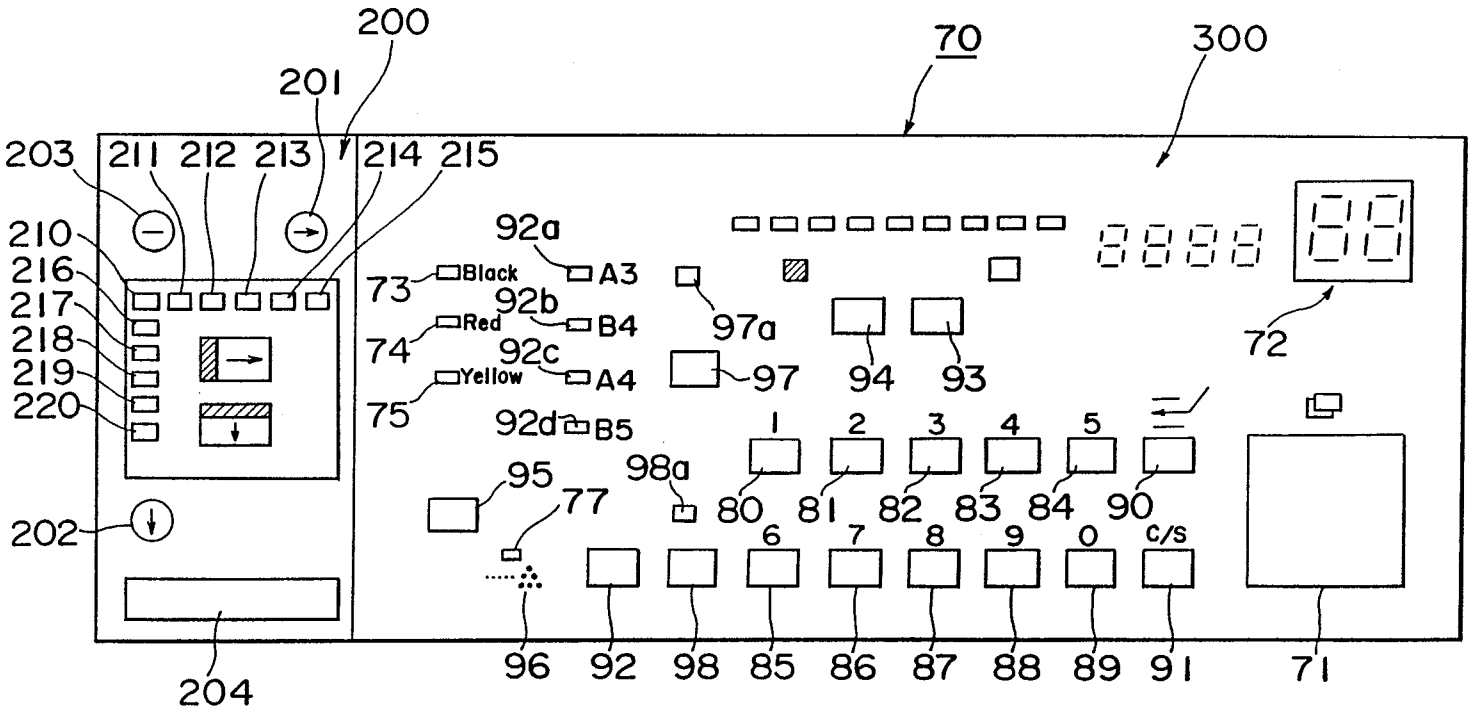
FIG. 10 is a plan view of a control panel of the copying machine.

The control panel 70 in the body of the copying machine will now be described with particular reference to FIG. 10.

The control panel 70 has a PRINT key 71; a number display LED 72 for the display of the number of copies to be made; toner color display LEDs 73, 74 and 75 which represent black, red and yellow toners, respectively; a toner empty display LED 77; tens keys 80 to 89; an INTERRUPTION key 90 for generating an interruption command; paper size select display LEDs 92*a* to 92*d* which represent A3, B4, A4 and B5 sizes of copying papers, respectively; and image density up and down keys 93 and 94.

The control panel 70 also has a first and second developing unit select key 95, a simultaneous bicolor copying mode select key 97, and a simultaneous bicolor copying mode display LED 97*a* for indicating an ON condition of the simultaneous bicolor copying mode select key.

The control panel 70 furthermore has an image editing setting area 200 including a lateral specifying key 201, a transverse specifying key 202 and a down key 203, and a COPY/ERASE reversal key 204. The lateral specifying key 201 can increase an erasing area in six stages at intervals of 70 mm in a direction in which the copying paper is supplied, whereas the transverse specifying key 202 can increase the erasing area in six stages at intervals of 50 mm in the direction of supply of the copying paper, the down key 203 being operable to stepwisely decreasing the erasing area.

While the specification of the copying area is performed in such a manner that the erasing area can be specified by the utilization of the lateral and transverse specifying keys 201 and 202 when an editing mode of the COPY/ERASE reversal key 203 is selected, the size of the erasing area can be adjusted by a choice function (not shown) in such a way as to stepwisely increase by an increment of 10 mm in both of the lateral and transverse directions. Also, each time the COPY/ERASE reversal key 204 is brought to an ON position, it can select one of Normal Mode, Editing Mode, Copy/Erase reversal and Normal Mode in the order given above. When during the the Editing Mode the copying area in the lateral direction or the transverse direction is specified by the use of the lateral specifying key 201 or the transverse specifying key 202 and, at the same time, the COPY/ERASE reversal key 204 is brought to the ON position, a copying can be accomplished with the specified copying area and the erasing area reversed relative to each other.

Values specified by the lateral and transverse specifying keys 201 and 202 are displayed in a magnification display 300 and a nominal display for each stage of 70 mm in the lateral direction and of 50 mm in the transverse direction is effected with LEDs 210 to 215 and LEDs 216 to 220, respectively.

Also, where the simultaneous bicolor copying mode select key 97 is brought to an ON position and the simultaneous bicolor copying mode is accordingly selected, the lateral specifying key 201 or the down key 203 is switched by a CPU 100 over to a position specifying key for the first and second developing units 4 and 5.

Figure 16:
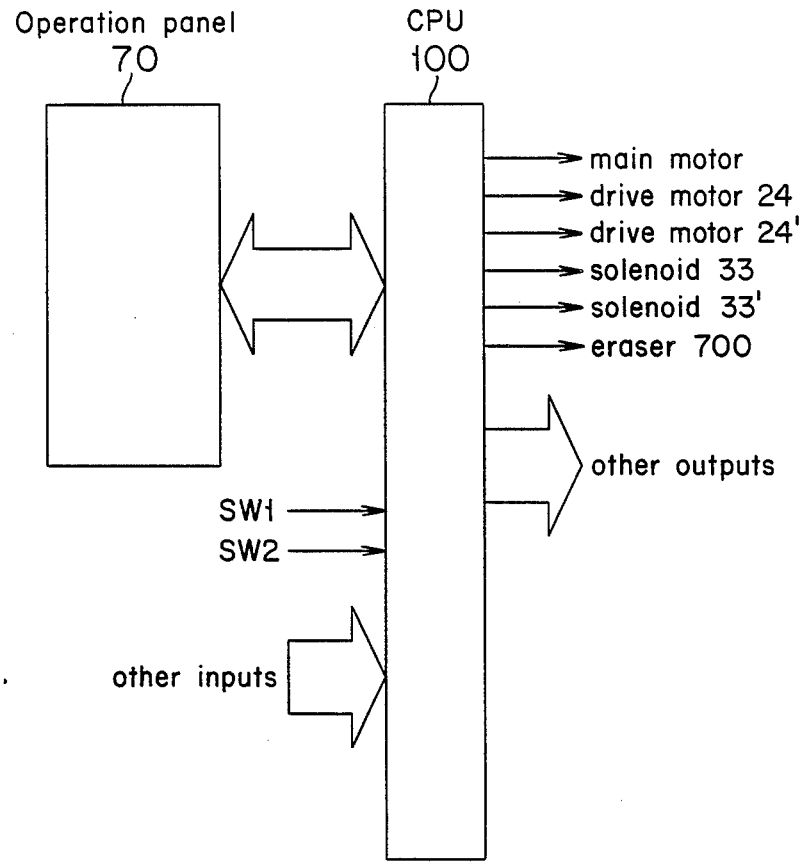
FIG. 16 is a block circuit diagram of a control unit used in the machine.

A block circuit diagram of the control unit is shown in FIG. 16. In FIG. 16, there is shown a connection between the operation panel 70 and the CPU. Output signals generated from the various switches in the operation panel 70 are applied to the CPU which in turn generates and supplies to the operation panel 70 output commands necessary to light LEDs. Also, in response to commands from the operation panel 70, the CPU supplies output signals to a main motor, the drive motors 24 and 24', the solenoid units 33 and 33', the eraser 700 and others. To the CPU, signals from the switches SW1 and SW2 for the developing units are also inputted.

The sequence of control performed by a control unit (not shown) will now be described with particular reference to FIGS. 11 to 15.

Figure 11:
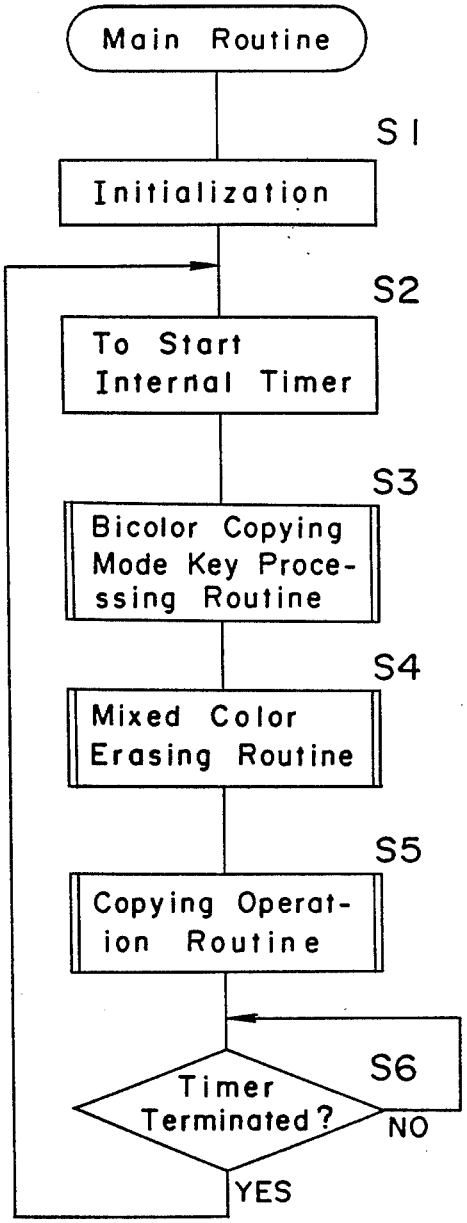
FIG. 11 is a flowchart showing a main routine.

The main routine shown in FIG. 11 illustrates a process of controlling the entire copying machine, and when the copying machine is powered on, an internal microcomputer is initialized at step S1.

At step S2, an internal timer is set to set one routine time for carrying the following process. In other words, in the copying machine, for each routine time which is a minute time, this process is executed.

At step S3, a simultaneous bicolor copying mode select key processing routine is executed. This routine will be described later.

At step S4, a mixed color erasing routine is executed as will be described later.

During the execution of a copying operation routine at step S5, the standard copying operation or the simultaneous bicolor copying operation as will be described later is executed.

At step S6, a decision is made to determine if the internal timer set at step S2 has been terminated, and, if it has been terminated, the flow return to step S2, but if it has not yet terminated, a wait takes place.

Figure 12:
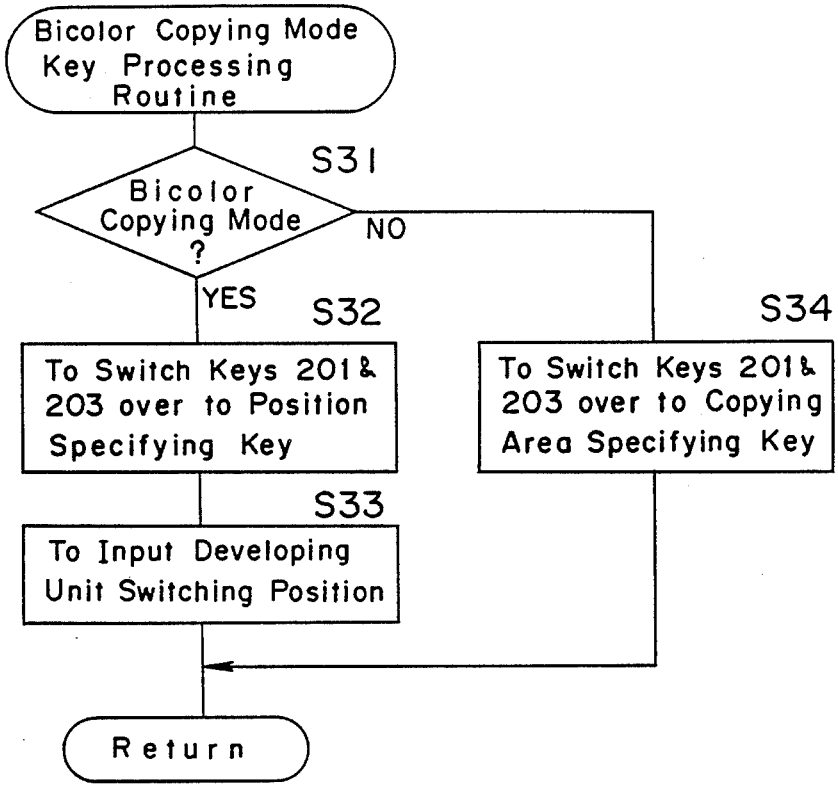
FIG. 12 is a flowchart showing a key processing routine to be executed during a simultaneous bicolor copying mode.

The simultaneous bicolor copying mode key processing routine will now be described. Referring now to FIG. 12, at step S31, a decision is made to determine if the simultaneous bicolor copying mode has been selected by the simultaneous bicolor copying mode select key 97. If the result of the decision indicates "Yes", the flow proceeds to step S32 at which lateral specifying key 201 and the down key 203 of the image editing setting area 200 are switched over to the developing unit switching position specifying key, followed by step S33 at which the developing unit switching position is read. Thereafter, the flow returns to the main routine. However, where the simultaneous bicolor copying mode has not been selected at step S31, the lateral specifying key 201 and the down key 203 are switched over to a copying area specifying key, followed by the return to the main routine.

Figure 13:
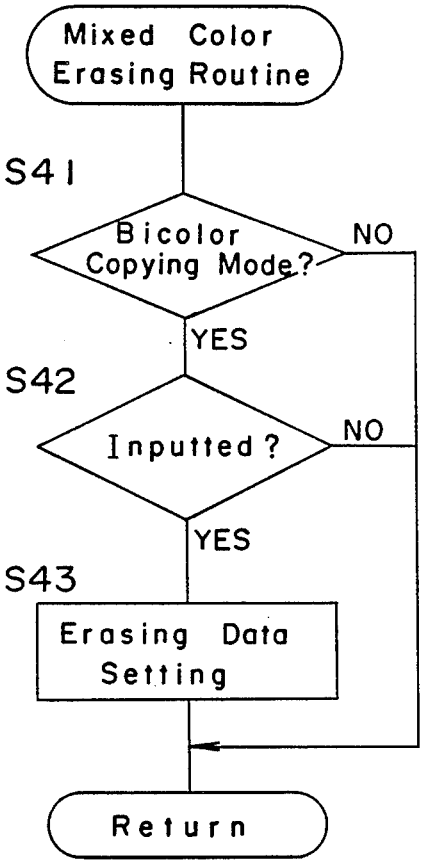
FIG. 13 is a flowchart showing a mixed color erasure processing routine.

FIG. 13 illustrates a flowchart for the mixed color erasing routine executed at step S4 of the main routine of FIG. 11.

At step S41, a decision is made to determine if the simultaneous bicolor copying mode has been selected by the simultaneous bicolor copying mode select key 97. If the result of the decision at step S41 indicates "Yes", another decision is made at step S42 to determine if the developing unit switching position has been inputted by the lateral specifying key 201 and the down key 203 which have been switched over to the developing unit switching specifying key. If the result of the decision at step S42 indicates "Yes", the lighting timing and the lighting time for the inter-image eraser 700 (FIG. 1) are determined at step S43 in reference to an inputted data of the developing unit switching position, respective data thereof being supplied to the inter-image eraser 700 prior to the return of the flow to the main routine. Where the respective results of the decisions at steps S41 and S42 indicate "No", the flow returns immediately to the main routine.

Figure 15:
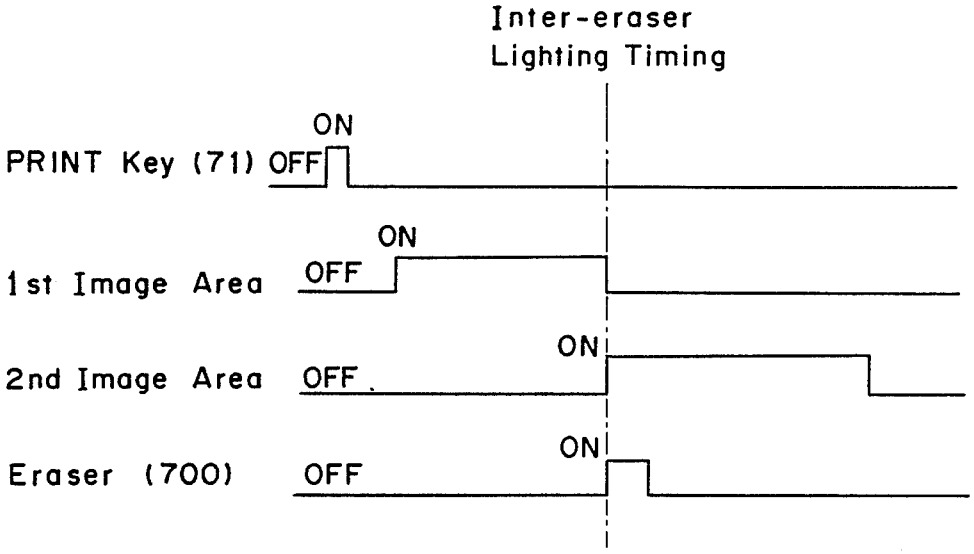
FIG. 15 is a timing chart showing the timing at which an inter-image eraser is energized.

The lighting time during which the inter-image eraser 700 is lit is determined beforehand depending on the degree in which a first image area developed by the first developing unit 4 sets down from an image density switching position and also on the degree in which the image density of a second image area developed by the second developing unit 5 sets up (See FIGS. 8 and 15).

Figure 14:
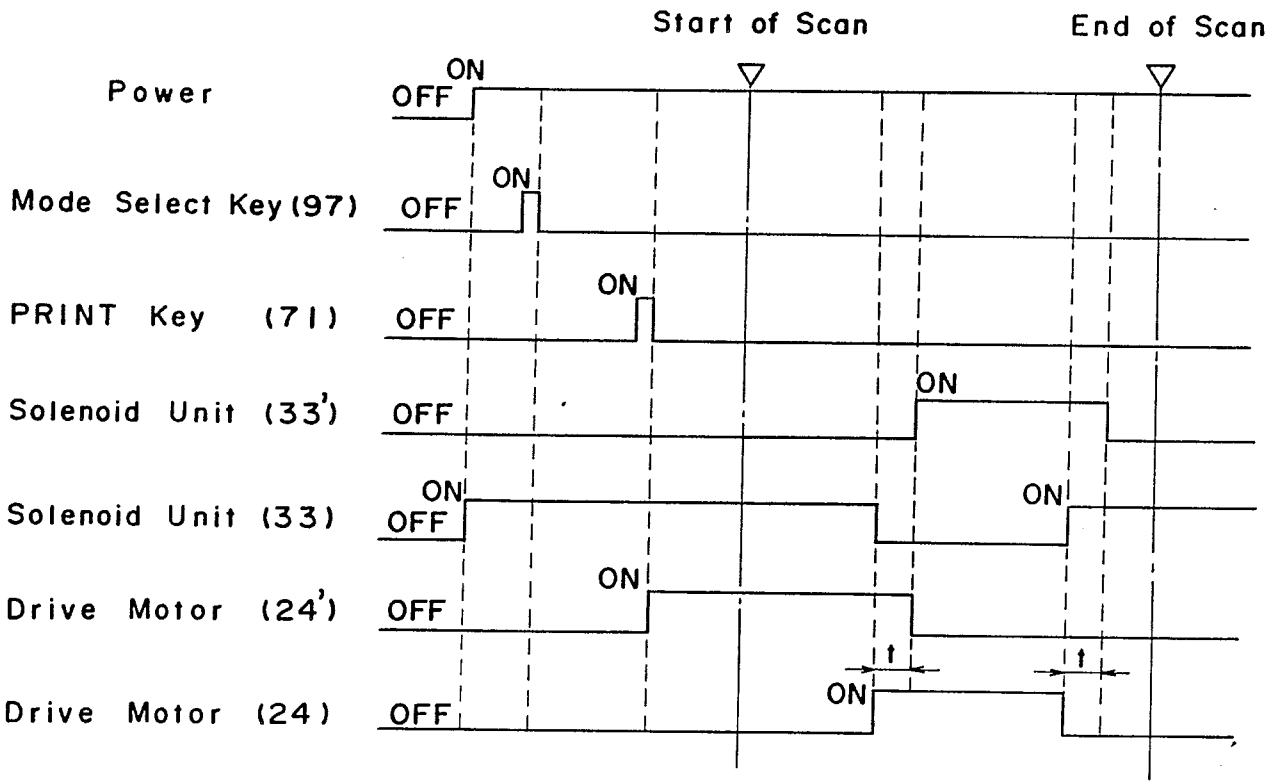
FIG. 14 is a timing chart showing the timed sequence of operation of various component parts of the copying machine.

The operation which takes place during the simultaneous bicolor copying mode will be described with reference to the timing chart shown in FIG. 14. It is to be noted that the component parts of the second developing unit 5 is distinguished from those of the first developing unit 4 by the presence of a prime "'".

Assuming that a main switch (not shown) of the copying machine is turned on to power the copying machine, the first developing unit 4 is held in position with the intermediate portion between the magnetic poles N1 and S1 confronting the photoreceptor drum 1 as shown in FIG. 6 and the second developing unit 5 is held in position with the magnetic pole N1 confronting the photoreceptor drum 1 as shown in FIG. 4.

Under these circumstances, when the PRINT key 71 is brought to an ON position, the second developing unit 5 accommodating the mass of black toner particles is automatically driven to execute the standard copying operation, but when the simultaneous bicolor copying mode select key 97 is brought to an ON position, it is set in a position in which the simultaneous bicolor copying mode as will be described later can be executed It is, however, to be noted that, even when the simultaneous bicolor copying mode select key 97 is depressed during the copying operation, the simultaneous bicolor copying mode will not be executed When the simultaneous bicolor copying mode select key 97 has been brought to the ON position, the copying mode is changed over from the normal copying mode to the simultaneous bicolor copying mode.

When the document to be copied has been placed on the document support 9 and the PRINT key 71 is subsequently brought to the ON position while the machine is set in the condition as hereinabove described, the drive motor 24' for the second developing unit 5 is started to rotate the developing sleeve 12', the supply roller 14' and the screw 15' in the respective directions shown by the arrows b, c and d.

By so doing, the developer containing the black toner particles accommodated within the casing 11' of the second developing unit 5 is circulated through the conveyance passages 16' and 17' by the rotation of the supply roller 14' and the screw 15' while being mixed and stirred and a portion thereof is supplied by the supply roller 14' onto the surface of the developing sleeve 12' to form magnetic brushes on the developing sleeve 12'.

The magnetic brushes are adjusted in height by the bristle height adjusting member 19' during the rotation of the developing sleeve 12' and are, then, successively transported through the bristle height adjusting gap Db towards the developing region X' to bring the electrostatic latent image on the photoreceptor drum 1 in position ready to be developed.

Also, as a result of the ON position of the PRINT key 71, the scanner 40 starts its movement in the direction shown by the arrow b to illuminate the document placed on the document support 9. Rays of light reflected from the document on the document support 9 are projected at the exposure point W onto the surface of the photoreceptor drum 1 to form the electrostatic latent image, the electrostatic latent image so formed being first developed by the second developing unit 5.

A portion of the electrostatic latent image which corresponds in position to the boundary at which color changes from black at the developing unit switching position specified by the lateral specifying key 201 or the down key 203 of the image editing setting area 200 is formed on a portion of the photoreceptor drum 1 which is aligned with the exposure point W and, at the timing at which this boundary having been moved from the position corresponding to the exposure point W aligns with the inter-image eraser 700, the inter-image eraser 700 is lit for a predetermined time to erase a predetermined range in a direction conforming to the scanning direction in reference to the boundary at which the developing unit has been switched over, and during a period of time during which this boundary moves from the position of the exposure point W to the position of the developing region X for the first developing unit 4, only the second developing unit 5 is operated.

Also, upon the arrival of the boundary of the electrostatic latent image as hereinbefore described at the developing region X, the drive motor 24 for the first developing unit is powered and the solenoid unit 33 for the first developing unit 4 is deenergized.

In this way, as is the case with the second developing unit 5, the first developing unit 4 is held in a condition as shown in FIGS. 4 and 5 with the developing sleeve 12, the supply roller 14 and the screw 15 rotating in the respective directions shown by the arrows b, c and d, the consequence of which is that magnetic brushes are formed on the developing sleeve 12 with the electrostatic latent image on the photoreceptor drum 1 brought in position ready to be developed. However, since the predetermined range in the direction, conforming to the scanning direction, from the boundary of the copying area specified by the image editing means in the manner as hereinbefore described is erased by the inter-image eraser 700 with the electrostatic latent image removed, the operation to supply colored toner particles (either red or yellow) onto the electrostatic latent image by means of the first developing unit 4 is initiated after the passage of the erased portion.

Then, after the passage of a time t subsequent to the start of the drive motor 24 for the first developing unit 4, that is, after a time (t=0.2 sec) during which the boundary of the electrostatic latent image moves from the developing region X to the developing region X' for the second developing unit 5, the drive motor 24' for the second developing unit 5 is turned off and the solenoid unit 33' for the second developing unit 5 is also deenergized. In this way, the second developing unit 5 is held in the condition shown in FIGS. 6 and 7 with the intermediate portion between the magnetic poles N1 and S1 confronting the photoreceptor drum 1 and the developing sleeve 12, the supply roller 14 and the screw 15 are brought to a halt, thereby completing the development of the copying area with the black toner particles. Further, upon the arrival of the electrostatic latent image of a trailing end of the color copying area at the developing region X, the drive motor 24 for the first developing unit 4 is turned off and the solenoid unit 33 for the first developing unit 4 is energized, thereby to complete the color development of an area B.

By the above described operation, during a period from the start of scan and the end of scan, a bicolor copy in which the developing color has been changed from black to color can be obtained.

Also, in the foregoing embodiment, reference has been made to the use of the black color developing unit as the first developing unit 4 and to the use of either the red color developing unit or the yellow color developing unit as the second developing unit 5. The present invention may not be limited thereto, but any one of the black, red and yellow color developing units can be selectively used as the first and second developing units 4 and 5 so that a copy having, for example, red and yellow colors can be obtained.

Moreover, although in the foregoing description the document support 9 has been described as fixed and the illuminator lamp 41 has been described as movable to scan the document on the document support, arrangement may be made in which the document support is movable and the illuminator lamp 41 is fixed.

It has also been described that the bicolor image could be obtained by switching over between the first and second developing units 4 and 5 during one cycle of scanning operation. The present invention is not always limited thereto. By way of example, arrangement may be made in which, during one cycle of scanning operation, an image up to the switching position is formed on the copying paper by the use of the second developing unit 5 and, after such copying paper has been temporarily stored in the intermediate tray 552, the image subsequent to the switching position can be formed on the same copying paper, then supplied from the intermediate tray 552, by the use of the first developing unit 4 to produce the bicolor image (referred to as bicolor synthesis). Even in this technique, the image of the document in the vicinity of the switching position can be removed by the eraser 700 thereby to avoid any possible color mixing.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A copying machine comprising:

a photosensitive member;

support means for supporting an original to be copied;

scanning means, which is movable under said support means from a start position to an end position, for scanning the original supported on the support means and projecting the scanned image of the original onto said photosensitive member thereby completing a single scanning operation to form an electrostatic latent image on said photosensitive member corresponding to the original;

eraser means for erasing the electrostatic latent image on the photosensitive member;

first developing means adapted to accommodate therein a mass of developer of first color for developing the electrostatic image on the photosensitive member with the first color developer;

second developing means adapted to accommodate therein a mass of developer of second color for developing the electrostatic image on the photosensitive member with the second color developer;

data input means for inputting a single input data which specifies a desired position located between the start position and the end position;

command input means for inputting a copy start command;

first control means for driving the first developing means and scanning means in response to the copy start command so as to partially develop the electrostatic latent image, formed by the scanning operation, from the start position to the desired position with the first color developer;

second control means for stopping the operation of the first developing means and starting the operation of the second developing means in accordance with said single input data thereby completing the development of the electrostatic latent image formed by the single scanning operation from the desired position to the end position with the second color; and third control means for operating said erasing means in accordance with said single input data so as to erase a predetermined range in the scanning direction with reference to said desired position.

2. A copying machine comprising:

a photosensitive member;

support means for supporting an original to be copied;

scanning means, which is movable under said support means from a start position to an end position, for scanning the original supported on the support means and projecting the scanned image of the original onto said photosensitive member thereby completing a single scanning operation to form an electrostatic latent image on the photosensitive member corresponding to the original;

eraser means for erasing the electrostatic latent image on the photosensitive member;

first developing means adapted to accommodate therein a mass of developer of first color for developing the electrostatic image on the photosensitive member with the first color developer;

second developing means adapted to accommodate therein a mass of developer of second color for developing the electrostatic image on the photosensitive member with the second color developer;

data input means for inputting a single input data which specifies a desired position located between the start position and the end position;

command input means for inputting a copy start command;

first control means for driving the first developing means and scanning means in response to the copy start command so as to partially develop the electrostatic latent image, formed by the scanning operation, from the start position to the desired position with the first color developer;

second control means for stopping the operation of the first developing means and starting the operation of the second developing means in accordance with said single input data thereby completing the development of the electrostatic latent image formed by the scanning operation from the desired position to the end position with the second color; and third control means for operating said erasing means for a predetermined time when said second control means switches off from said first developing means to said second developing means.

* * * * *